United States Patent [19]

Bondarenko et al.

[11] 4,000,361

[45] Dec. 28, 1976

[54] ELECTROSLAG REMELTING FURNACE WITH RELATIVE DISPLACEMENT OF A MOULD AND AN INGOT BEING CAST

[76] Inventors: Oleg Petrovich Bondarenko, ulitsa Kreschatik, 15, kv. 36; Alexandr Mikhailovich Marchenko, ulitsa stroitelei, 17, kv. 18; Alexei Georgievich Bogachenko, ulitisa Miljutenko, 15/2, kv. 141; Vitaly Mikhailovich Baglai, bulvar Lesi ukrainki, 2, kv. 51; Igor Andrianovich Genis, ulitsa Krasnoarmeiskaya, 92, kv. 37, all of Kiev, U.S.S.R.

[22] Filed: Oct. 22, 1975

[21] Appl. No.: 624,836

[30] Foreign Application Priority Data

Nov. 28, 1974 U.S.S.R. ..... 2076266

[52] U.S. Cl. ..... 13/9 ES; 164/154

[51] Int. Cl.[2] ..... H05B 7/148

[58] Field of Search ..... 13/9 ES, 13; 164/4, 164/154

[56] References Cited

UNITED STATES PATENTS

| | | | |
|---|---|---|---|
| 3,622,678 | 11/1971 | Allen | 13/13 ES |
| 3,834,443 | 9/1974 | Ujiie | 164/52 |

*Primary Examiner*—R. N. Envall, Jr.
*Attorney, Agent, or Firm*—Holman & Stern

[57] ABSTRACT

An electroslag remelting furnace with relative displacement of a mould and an ingot being cast is provided with an electric control circuit for controlling the displacement of consumable electrodes, an electric control circuit for controlling the displacement of the mould, and an electric control circuit for controlling the power input in accordance with the rate of the ingot remelting, all of the electric circuits being electrically coupled to one another.

2 Claims, 1 Drawing Figure

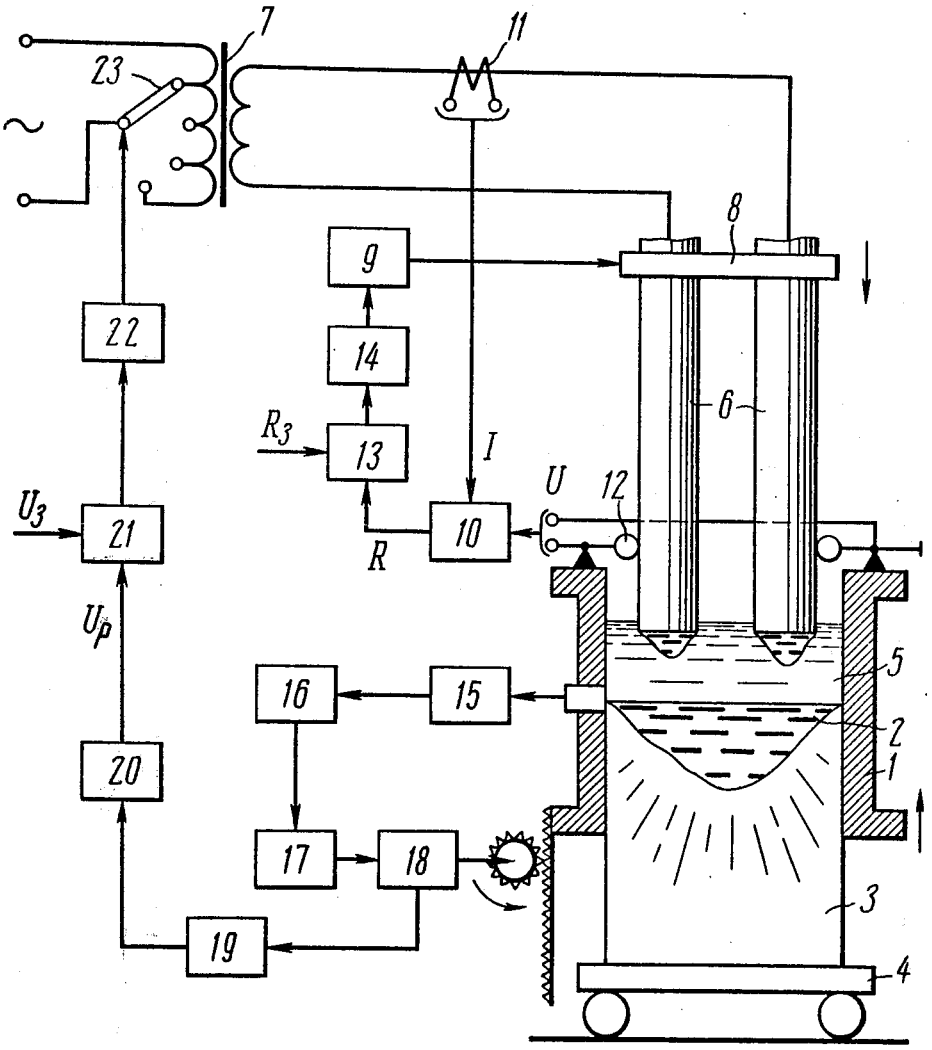
7
11
23
8
9
22
14
6
$R_3$
13
I
U
12
$U_3$
21
10
R
$U_p$
5
16
15
2
20
1
17
18
3
19
4

ELECTROSLAG REMELTING FURNACE WITH RELATIVE DISPLACEMENT OF A MOULD AND AN INGOT BEING CAST

BACKGROUND OF THE INVENTION

The invention relates to steel production by the electroslag remelting method, and more specifically to electroslag remelting furnaces with relative displacement of a mould and an ingot being cast.

The principle of operation of a electroslag remelting furnace with relative displacement of a mould and an ingot being cast and comprising an automatic control system based on the weight rate of the ingot casting, may be used in plasma-arc remelting furnaces, electron beam remelting furnaces and electroslag welding installations using this system.

Known in the art are electroslag remelting furnaces having systems for controlling production parameters in stationary moulds using indirect control parameters, such as electrode flashing current, voltage drop across a slag bath, furnace transformer voltage, feed rate of electrodes, resistance of an interlectrode gap and the like. Several parameters may also be used in combination.

Known in the art is a furnace comprising a stationary water chilled mould wherein the electroslag remelting and formation of an ingot from molten metal take place. Consumable electrodes remelted in the mould are connected to a furnace transformer by means of power supply cables. The electrodes are fixed with the top part thereof to an electrode holder mounted for movement along a furnace column.

At the beginning of the process, a carriage of the electrode holder with electrodes secured therein is at the top portion of the furnace column. During the melting of the electrodes, the carriage moves down along the column. The automatic control of the process is effected by controlling the feed of the electrodes. The electrodes are fed in accordance with the slag bath resistance, which is the resistance between the electrodes and the ingot being cast. For that purpose, the furnace is provided with a control system for controlling the displacement of the electrodes which is placed at a control board and consists of a series circuit including: a unit for measuring active resistance, a comparator unit, an amplifier and a drive for displacement having a reducing gear. Signals proportional to the flashing current of the electrodes (from a current transformer) and to the furnace transformer voltage are fed to the unit for measuring active resistance of the slag bath. The signal at the output of the unit for measuring active resistance, which is proportional to the actual resistance of the slag bath, is compared to a preset signal value. The difference in these signals is fed, via the amplifier, to the drive for displacing the electrodes which restores the preset resistance value.

It should be noted, however, that the measurements in the method of controlling the process in accordance with the resistance of the slag bath are effected with great errors. The consumable electrodes are heated during the remelting and are shortened as they are consumed. The active resistance of the electrodes varies during the entire casting period, and the control system takes no account of that. The resistance of the slag bath is an indirect parameter of the process which cannot insure an accurate maintenance of the rate of ingot remelting which represents the main parameter affecting the quality of metal.

Known in the art is also an electroslag remelting furnace for casting ingots of up to 14 tons. The furnace comprises a stationary water chilled mould which is mounted on a bottom and has a slag bath in which an electrode is melted under the action of current fed from a furnace transformer and in which molten metal is cast into an ingot. A consumable electrode of a round section has a standard head for locking in an electrode holder. The electrode holder is mounted on a carriage which is positioned at the top portion of the column at the beginning of the process. During the entire remelting period, the carriage of the electrode holder with the electrode secured therein moves down along the column as the electrode is consumed.

The primary control of the process for maintaining and controlling the melting speed is effected by a system for weighing the consumable electrode.

The standard electrode head is screwed into a weight cell which is mounted in the electrode holder cross piece. In this position, the weight cell senses the entire weight of the electrode holder, a standard head, electrode residue and a part of the weight of water for cooling the cables. Electric signals from the cell are fed to an amplifier and therefrom, to a measuring instrument. As the electrode is consumed, its weight changes, and the rate of remelting of an ingot may be computed.

The use of the weight cell in the control system for controlling the electroslag remelting process is very difficult because there are a number of factors influencing the readings of the cell which cannot be taken into account. The load on the cell from the power supply cables varies with the altitude of the electrode holder. When the electrode holder is in the upmost position, the cable weight is at its maximum. As the carriage is lowered, the cable weight decreases, and this variation is non-linear. The current value change during the melting results in a change in the magnetic field which negatively affects the accuracy of the readings of the weight cell.

Therefore, the prior art systems for controlling the electroslag remelting process have a number of substantial disadvantages. They cannot provide for maintaining a sufficiently accurate rate of ingot remelting since the process control is being conducted in accordance with indirect parameters, whereas the rate of ingot remelting is the main production parameter affecting the quality and structure of an ingot being cast.

SUMMARY OF THE INVENTION

It is an object of the invention to eliminate the above disadvantages of electroslag remelting furnaces having known control systems.

Another object of the invention is to provide an electroslag remelting furnace with relative displacement of a mould and an ingot being cast and comprising a control circuit for controlling the remelting process in accordance with the main production parameter, the rate of the ingot remelting.

The above objects are accomplished by an electroslag remelting furnace with relative displacement of a mould and an ingot being cast, wherein an electric control circuit for controlling the displacement of consumable electrodes comprises a transducer sensing the resistance of an interelectrode gap and acting, via a resistance comparator unit and an amplifier, on a drive for displacing the consumable electrodes as they are flashed, and wherein the control of displacement of the mould relative to the ingot being cast is effected by means of an electric control circuit comprising a metal level sensor connected, via a regulator, to a drive for displacing the mould, and wherein a control circuit for controlling the power input in accordance with the ingot remelting rate includes a device for measuring the speed of displacement of the mould having an input connected to the drive for displacing the mould and an output connected, via an analog-digital converter, to an input of a comparator unit for comparing the actual and preset speeds of displacement of the mould, the output of the comparator unit being connected to a power supply source comprising a furnace transformer having a device for switching voltage steps thereof.

The device for measuring the speed of displacement of the mould preferably comprises a pulse counter.

The electroslag remelting furnace with relative displacement of a mould and an ingot being cast and comprising the production control system permits the control of the process in an automatic manner on the basis of the main production parameter, the rate of the ingot remelting which, is especially important in casting products of an intricate cross-sectional shape. This method of controlling the process contributes to an improvement of quality of the remelted metal and reduces non-uniformity of chemical composition of an ingot along its length, while the yield of suitable metal is increased.

The process control in accordance with the rate of remelting of the ingot may be used in plasma-arc, and electron beam remelting furnaces, as well as in electroslag welding installations.

BRIEF DESCRIPTION OF THE DRAWING

The invention will now be described in detail with reference to a specific embodiment thereof illustrated in the accompanying drawing showing a structural diagram of an electroslag remelting furnace with relative displacement of a mould and an ingot being cast and comprising a control circuit for controlling the power input in accordance with the rate of the ingot remelting.

DETAILED DESCRIPTION OF THE PREFERRED EMBODIMENT

According to the invention, the electroslag remelting furnace comprises a water chilled mould 1 in which molten metal 2 is remelted into an ingot 3. Initially, the mould 1 is positioned on a bottom of a car 4. The remelted ingot 3 may be secured to the bottom of the car 4 by means of dummy bars, and the car 4 may be vertically displaced, together with the ingot 3, relative to the mould 1. A slag bath 5 is provided in the mould 1 over the ingot 3, and the metal remelting process takes place in this bath under the action of electric current. Consumable electrodes 6 connected to a power supply source comprising a furnace transformer 7 are used for casting the ingot.

The consumable electrodes 6 may be of any appropriate size and cross-sectional shape, e.g. round, square or rectangular. The number of consumable electrodes is selected depending on the remelting application, each having its own circuit for connection to the furnace transformer 7.

The consumable electrodes 6 are fixed with their top portions to an electrode holder 8 having a cross piece which can be vertically displaced (coaxially with the mould 1) by a drive 9 for displacing the consumable electrodes.

The displacement of the consumable electrodes 6 is effected automatically in accordance with an electric parameter, the resistance of the interelectrode gap, and for that purpose an electric control circuit is used for controlling the displacement of the consumable electrodes. The electric circuit for controlling the displacement of the consumable electrodes comprises a transducer 10 for sensing the resistance of the interelectrode gap which is made in the form of a dividing device and connected to a current transformer 11 for measuring the flashing current at the consumable electrodes 6 and to current collectors 12 mounted on the mould 1 at the top portion thereof for measuring the voltage drop across the interelectrode gap directly adjacent to the slag bath 5.

The resistance transducer 10 is electrically coupled to a comparator unit 13 for effecting the comparison of a preset resistance of the interelectrode gap set-up in accordance with a predetermined programme, and the actual value of this resistance. The difference signal from the comparator unit 13 is amplified in a standard amplifier 14 and fed to the drive 9 for displacing the consumable electrodes which causes the lowering of the electrodes 6 at a predetermined speed as they are consumed.

As the electrodes 6 are consumed, the molten metal level in the mould 1 rises. For continuance of the process in the automatic mode, it is required to displace the mould 1 relative to the level of the molten metal 2. For that purpose, the electroslag remelting furnace has an electric circuit for controlling the displacement of the mould 1 in accordance with a physical parameter, the level of the molten metal 2.

This electric control circuit comprises a molten metal level sensor 15 which is incorporated in the moulding wall of the mould 1 and has an individual water cooling system. The signal from the molten metal level sensor 15 is amplified in an amplifier 16. The amplifier 16 is electrically coupled to a regulator 17 mounted at the control board of the electroslag remelting furnace for controlling the operation of a drive 18 for displacing the mould 1 relative to the level of the molten metal 2. The electric control circuit ensures the accuracy of the molten metal level in the mould 1 within ±3 mm.

The electric control circuit for controlling the displacement of the consumable electrodes and the electric control circuit for controlling the displacement of the mould are interconnected via a circuit for controlling the power input in accordance with the rate of the ingot remelting. The circuit for controlling the power input in accordance with the rate of the ingot remelting comprises a device for measuring the speed of displacement of the mould made in the form of a pulse counter 19. A sensitive member of the pulse counter 19 is mounted on the shaft of the drive 18 for displacing the mould 1. The pulse counter 19 counts the number of revolutions of the shaft of the drive 18 per unit of time, that is the speed of displacement of the mould 1. Since the speed of displacement of the mould 1 is usually low and is of the order of from 3 to 20 mm/min, it is preferred that the pulse counter 19 be of the contactless type which is the simplest and most reliable.

The pulse counter 19 is electrically coupled to an analog-digital converter 20 connected to a comparator unit 21 which compares the preset speed of the mould 1 set-up by the programme and the actual speed of the mould 1, that is the speed of remelting.

The comparator unit 21 is connected, via a device 22 for switching voltage steps 23 of the furnace transformer 7, to the furnace transformer 7. The steps 23 are switched at the primary winding of the furnace transformer 7 thereby varying the voltage and current (that is the power input) applied to melt the electrodes in the electroslag remelting furnace.

All three control circuits of the electroslag remelting furnace use standard units having modularized input and output constructions.

The electroslag remelting furnace with relative displacement of the mould and ingot being cast and comprising the circuit for controlling the power input in accordance with the rate of the ingot remelting operates in the following manner.

After forming the slag bath 5 in the mould 1, which is initially on the bottom of the car 4, the melting of the consumable electrodes 6 in the electroslag remelting furnace begins. Thus, initially, the electric control circuit for controlling the displacement of the electrodes 6 in accordance with the electric parameter, the resistance of the interelectrode gap, is actuated.

The electric parameters of the electroslag remelting furnace, that is the voltage across the electrodes 6 and the current flowing in the electrodes and measured by the current transformer 11 are fed to the dividing device comprising the resistance transducer 10. The electric parameter, the resistance of the interelectrode gap, is fed from the output of the resistance transducer 10 to the comparator unit 13 for comparing the actual and preset values of the resistance of the interelectrode gap. The difference signal is amplified in the amplifier 14 and fed to the drive 9 for displacing the electrodes 6. The drive 9 for displacing the electrodes 6 effects the displacement of the carriage of the electrode holder 8 with the electrodes 6 fixed thereto. The displacement of the electrodes 6 provides for maintenance of a preset value of the resistance of the interelectrode gap in accordance with the programme. The control law is the following:

$$R_1 - R_2 \rightarrow O,$$

wherein $R_1$ and $R_2$ are the actual and preset values, respectively, of the resistance of the interelectrode gap.

As the electrodes 6 are consumed, and the ingot 3 is cast, the level of the molten metal 2 rises relative to the mould 1, and the electric control circuit for controlling the displacement of the mould 1 in accordance with the physical parameter, the level of the molten metal 2, is actuated. When the level of the molten metal 2 reaches the level sensor 15 incorporated in the moulding wall of the mould 1, the level sensor detects the presence of the molten metal 2 and feeds an electric signal to the amplifier 16. The signal from the amplifier 16 is fed to the regulator 17 which is electrically coupled to the drive 18 for displacing the mould 1. The drive 18 for displacing the mould 1 lifts the movable mould 1 relative to the ingot 3 being cast in accordance with the level of the molten metal 2. The control law is the following:

$$H_1 - H_2 \rightarrow O,$$

wherein $H_1$ and $H_2$ are the actual and preset values, respectively, of the level of the molten metal 2 in the mould 1.

For controlling the remelting process in accordance with the rate of remelting of the ingot 3, the output of the drive 18 for displacing the mould 1 in accordance with the level of the molten metal 2, is connected to a series circuit comprising the pulse counter 19 and the analog-digital converter 20 having its output value proportional to the speed of displacement of the mould 1 relative to the level of the molten metal 2. The signal from the analog-digital converter 20 is fed to the comparator unit 21 generating a resultant signal after the comparison of the preset speed and the actual ingot remelting speed.

The resultant signal is fed to the device 22 for switching the voltage steps 23 of the furnace transformer 7 which causes an increase or decrease in the flashing current of the electrodes 6 thereby increasing or decreasing the power input.

The rate of remelting of the ingot 3 is respectively increased or decreased.

The electroslag remelting furnace functions in the above-described manner during the entire electroslag remelting cycle.

What is claimed is:

1. An electroslag remelting furnace with relative displacement of a mould and an ingot being cast comprising: a power supply source in the form of a furnace transformer; a circuit for controlling the displacement of consumable electrodes comprising:

a transducer sensing the resistance of an interelectrode gap which comprises a dividing device and is connected to the power supply source circuit; a comparator unit for comparing a preset value of resistance of the interelectrode gap and the actual value of the resistance, the comparator unit being electrically coupled to the resistance transducer; and a drive for displacing the consumable electrodes which is electrically connected, at one side, to the comparator unit via an amplifier, and at the other side, to an electrode holder for the consumable electrodes;

an electric circuit for controlling the displacement of the mould relative to the ingot being cast comprising:

a molten metal level sensor connected, via a regulator, to a drive for displacing the mould; and a circuit for controlling the power input in accordance with the rate of the ingot remelting comprising:

a device for measuring the speed of displacement of the mould having an input connected to the drive for displacing the mould and an output connected, via an analog-digital converter, to an input of a comparator unit for comparing actual and preset speeds of the mould, the output of the comparator unit being connected to the power supply source via a device for switching voltage steps thereof.

2. The electroslag remelting furnace with relative displacement of a mould and an ingot being cast as claimed in claim 1, wherein the device for measuring the speed of displacement of the mould comprises a pulse counter.

* * * * *